US007179053B2

(12) United States Patent
Kim et al.

(10) Patent No.: US 7,179,053 B2
(45) Date of Patent: Feb. 20, 2007

(54) AIR-BLOWING APPARATUS OF CLEANER

(75) Inventors: Wook Kim, Kyungki-do (KR); Wan Ho Jeon, Inchun-si (KR); Chang Joon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 147 days.

(21) Appl. No.: 10/916,587

(22) Filed: Aug. 12, 2004

(65) Prior Publication Data

US 2005/0169750 A1 Aug. 4, 2005

(30) Foreign Application Priority Data

Feb. 3, 2004 (KR) ..... 10-2004-0006953

(51) Int. Cl.
*F04D 29/30* (2006.01)

(52) U.S. Cl. ..... 415/211.2; 416/228

(58) Field of Classification Search ..... 415/211.2, 415/224.5; 416/228, 236 R, 223 B
See application file for complete search history.

(56) References Cited

U.S. PATENT DOCUMENTS 2,362,514 A * 11/1944 Warner ..... 415/208.3
2,967,013 A * 1/1961 Dallenbach et al. ..... 415/181
5,178,516 A * 1/1993 Nakagawa et al. ..... 415/208.3
5,595,473 A * 1/1997 Nagaoka et al. ..... 415/199.1
6,592,329 B1 7/2003 Hirose et al.

FOREIGN PATENT DOCUMENTS

| | | |
|---|---|---|
| CN | 2426028 | 4/2001 |
| CN | 1300350 | 6/2001 |
| JP | 4-311698 | 11/1992 |
| JP | 05-087094 | 4/1993 |

OTHER PUBLICATIONS

English language Abstract of JP 4-311698.
English Language Abstract of CA 1300350.
English language Abstract of JP 05-087094.

* cited by examiner

*Primary Examiner*—Ninh H. Nguyen
(74) *Attorney, Agent, or Firm*—Greenblum & Bernstein, P.L.C.

(57) ABSTRACT

Disclosed herein is an air-blowing apparatus of a cleaner. The air-blowing apparatus comprises a fan having a plurality of blades spaced apart from each other in the circumferential direction of the fan for generating a blowing force in the centrifugal direction thereof, and a diffuser disposed outside the fan in the radial direction of the fan for diffusing air blown from the fan. Each blade is formed such that at least a part of the blade is shorter than the other part of the blade extending to the outer diameter of the fan, whereby noise is reduced while blowing efficiency is not affected.

13 Claims, 6 Drawing Sheets

AIR-BLOWING APPARATUS OF CLEANER

BACKGROUND OF THE INVENTION

1. Field of the Invention

The present invention relates to an air-blowing apparatus of a cleaner, and more particularly to an air-blowing apparatus of a cleaner wherein the distance between a fan and a diffuser is partly increased, whereby flow loss is minimized and noise is reduced.

2. Description of the Related Art

FIG. 1 is a view showing the construction of a cleaner with a conventional air-blowing apparatus mounted therein.

Generally, a cleaner comprises: a main body 2; and a suction unit 4 connected to a suction hole 1 formed at the front part of the main body 2 for suctioning waste accumulated on the floor with air. The main body 2 comprises: a dust-collecting compartment 6 for collecting the waste suctioned by means of the suction unit 4, filtering the air, and discharging the filtered air; and an air-blowing apparatus 'B' for generating a suction force necessary to introduce the waste into the interior of the main body 2 via the suction unit 4 along with air. At the rear part of the main body 2 is formed a main body side discharging hole 3 for discharging the air having passed through the air-blowing apparatus 'B' to the outside of the main body 2.

FIG. 2 is a cross-sectional view, in part, showing the conventional air-blowing apparatus of the cleaner.

The conventional air-blowing apparatus 'B' of the cleaner comprises: an impeller 10 for generating a blowing force; and a motor 20 mounted to the rear of the impeller 10 for driving the impeller 10.

The impeller 10 comprises: an impeller housing 12 having an impeller suction hole 11, through which air is suctioned, formed at the front part thereof, and an opening 13 formed at the rear part thereof; a fan 14 rotatably mounted in the impeller housing 12 for blowing air by means of the centrifugal force; and a diffuser 16 securely fixed around the fan 14, in the radial direction thereof, while the diffuser 16 is spaced a prescribed distance 'G' from the fan 14, for diffusing the air blown from the fan 14.

At the rear of the diffuser 16 may be disposed a guide vane 18 for guiding the air having passed through the diffuser 16 to the motor 20.

The motor 20 comprises: a motor housing 22 having an opening 21 formed at the front part thereof, the opening 21 of the motor housing 22 communicating with the opening 13 formed at the rear part of the impeller housing 12; a stator 24 fixed to the motor housing 18; and a rotor 26 rotatably mounted in the stator 24, the rotor 26 being connected to the fan via a rotary shaft 25.

At the side rear part of the motor housing 22 is formed a motor side discharging hole 23 for discharging air.

Operation of the conventional air-blowing apparatus of the cleaner with the above-stated construction will now be described.

When the stator 24 is energized, a magnetic field is created, by means of which the rotor 26 is rotated. As the rotor 26 is rotated, the fan 14 is also rotated to generate a blowing force, by means of which outside air is forcibly sent to the impeller housing 12 through the impeller suction hole 11.

The air forcibly sent to the impeller housing 12 is blown to the fan 14 in the axial direction thereof, and then the air is blown to the radial outer circumference of the fan 14. Subsequently, the air is diffused 16 by means of the diffuser 16, is guided by means of the guide vane 18, and is then blown to the motor housing 22.

The air blown to the motor housing 22 is sent toward the rear of the motor housing 22 so that the motor 20 is cooled. Finally, the air is discharged to the outside of the motor housing 22 through the motor discharging hole 23.

In the conventional air-blowing apparatus of the cleaner, the distance between the fan 14 and the diffuser 16 is relatively small in the radial direction of the fan 14 so that flow loss of air between the fan 14 and the diffuser 16 is minimized. When air is blown from the fan 14 to the diffuser 16, the air is disturbed since the diffuser 16 is fixed to the impeller housing 12 while the fan 14 is rotated. Consequently, a serious problem of noise is caused.

SUMMARY OF THE INVENTION

Therefore, the present invention has been made in view of the above problems, and it is an object of the present invention to provide an air-blowing apparatus of a cleaner that is capable of reducing noise generated due to disturbance while minimizing flow loss of air between a fan and a diffuser.

In accordance with one aspect of the present invention, the above and other objects can be accomplished by the provision of an air-blowing apparatus of a cleaner, comprising: a fan for generating a blowing force in the centrifugal direction thereof; and a diffuser disposed outside the fan in the radial direction of the fan for diffusing air blown from the fan, wherein the distance between the fan and the diffuser is partly increased.

The fan may have a plurality of blades spaced apart from each other in the circumferential direction of the fan, and each of the blades may be formed such that at least a portion of the distance between the fan and the diffuser is relatively large and such that at least a part of the blade is shorter than the other part of the blade extending to the outer diameter of the fan.

Each of the blades of the fan may be symmetrical in the axial direction of the fan.

The blades of the fan may be formed such that the minimum distance of each blade of the fan from the center of the fan to the end of the fan at the side of the diffuser in the radial direction of the fan is 90 to 99% of the outer diameter of the fan.

Both ends of each blade of the fan may be shorter, in the axial direction of the fan, than the middle of the blade.

Each blade of the fan may be gradually shortened, in the form of a straight or curved line, from the middle of the blade to both ends of the blade in the axial direction of the fan.

Each blade of the fan may have grooves formed, in the axial direction of the fan, between the middle of the blade and both ends of the blade, respectively.

The middle of each blade of the fan may be shorter, in the axial direction of the fan, than both ends of the blade.

Each blade of the fan may be gradually shortened, in the form of a straight or curved line, from both ends of the blade to the middle of the blade in the axial direction of the fan.

Each blade of the fan may have a rectangular groove formed at the middle of the blade. Furthermore, each blade of the fan may have a triangular groove formed at the rectangular groove toward the center of the fan.

Each blade of the fan may have an elliptical groove formed at the middle of the blade, the elliptical groove being partly cut.

Each blade of the fan may have straight line parts gradually shortened in the form of a straight line in the axial direction of the fan and curved line parts gradually shortened in the form of a curved line in the axial direction of the fan.

In accordance with another aspect of the present invention, there is provided an air-blowing apparatus of a cleaner, comprising: a fan having a plurality of blades spaced apart from each other in the circumferential direction of the fan for generating a blowing force in the centrifugal direction thereof; and a diffuser disposed outside the fan in the radial direction of the fan for diffusing air blown from the fan, wherein each of the blades is formed such that at least a part of the blade is shorter than the other part of the blade extending to the outer diameter of the fan, the minimum distance of each blade of the fan from the center of the fan to the end of the fan at the side of the diffuser in the radial direction of the fan is 90 to 99% of the outer diameter of the fan, and each of the blades of the fan is symmetrical in the axial direction of the fan.

Both ends of each blade of the fan may be shorter, in the axial direction of the fan, than the middle of the blade.

The middle of each blade of the fan may be shorter, in the axial direction of the fan, than both ends of the blade.

Each blade of the fan may be gradually shortened, in the form of a straight or curved line, in the axial direction of the fan.

In the air-blowing apparatus of the cleaner with the above-mentioned construction according to the present invention, at least a portion of the distance between a fan and a diffuser is larger, in the axial direction of the fan, than the other portion of the distance, whereby noise is reduced while blowing efficiency is not seriously affected.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

Although various preferred embodiments of the present invention may be proposed, an air-blowing apparatus of a cleaner according to the most preferred embodiment of the present invention will be described below. The basic construction of the air-blowing apparatus of the cleaner according to the present invention is identical to that of the conventional air-blowing apparatus of the cleaner, the detailed description of which will therefore not be given.

Figure 1:
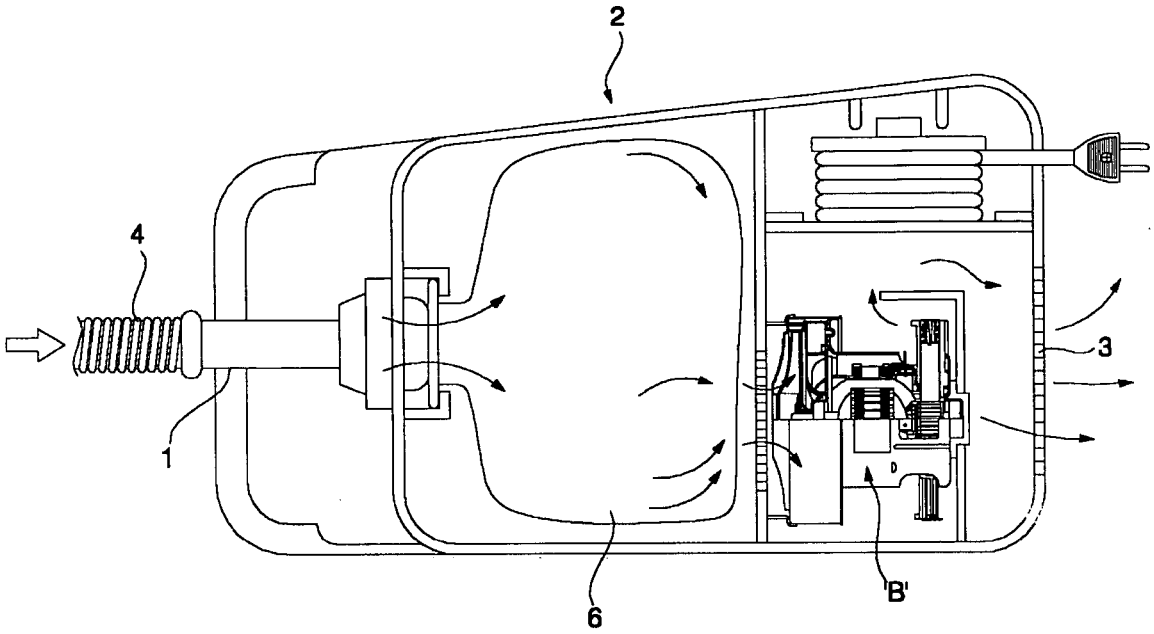
FIG. 1 (Prior Art)
FIG. 1 is a view showing the construction of a cleaner with a conventional air-blowing apparatus mounted therein.
Figure 2:
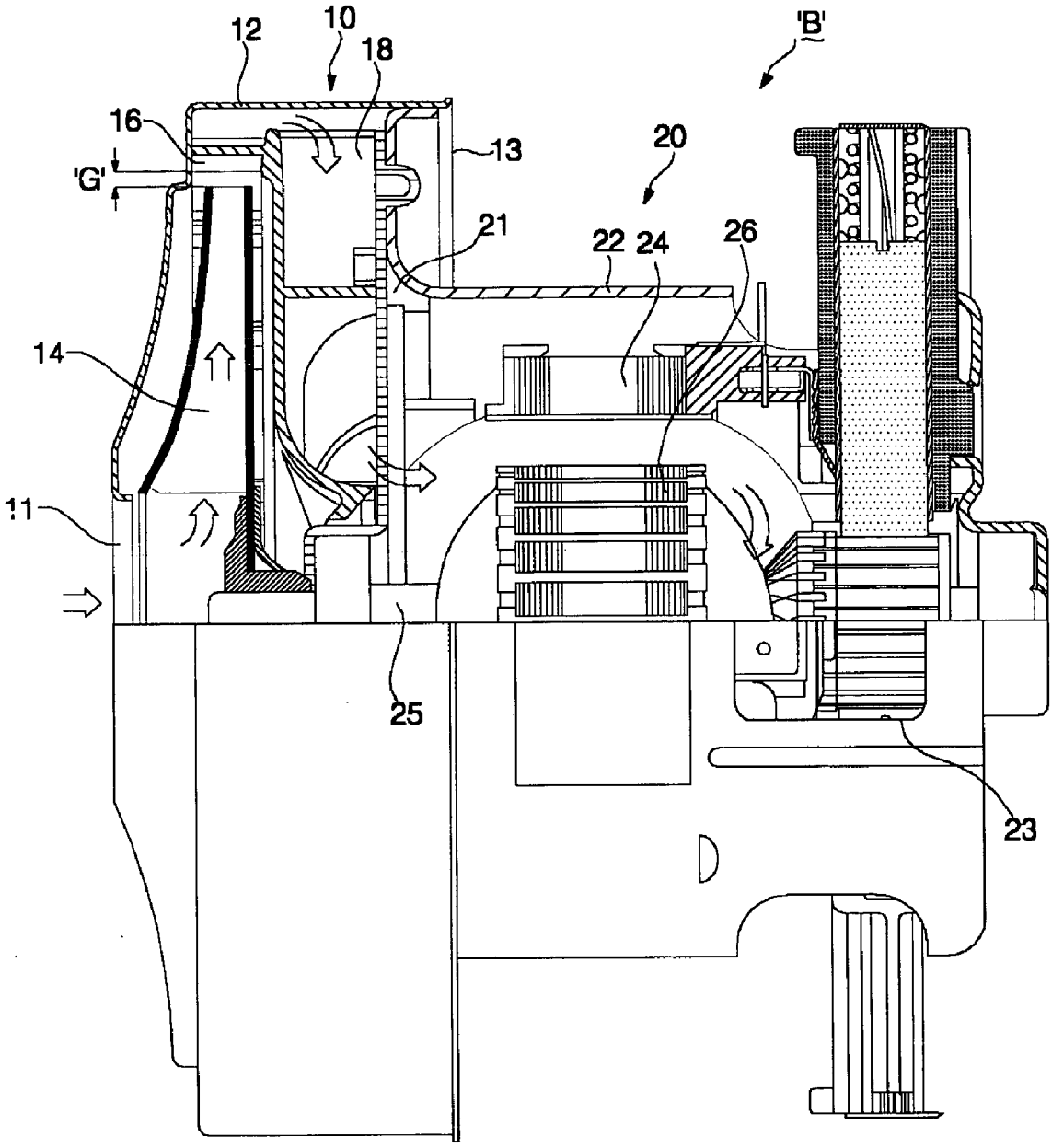
FIG. 2 (Prior Art)
FIG. 2 is a cross-sectional view, in part, showing the conventional air-blowing apparatus of the cleaner.
Figure 3:
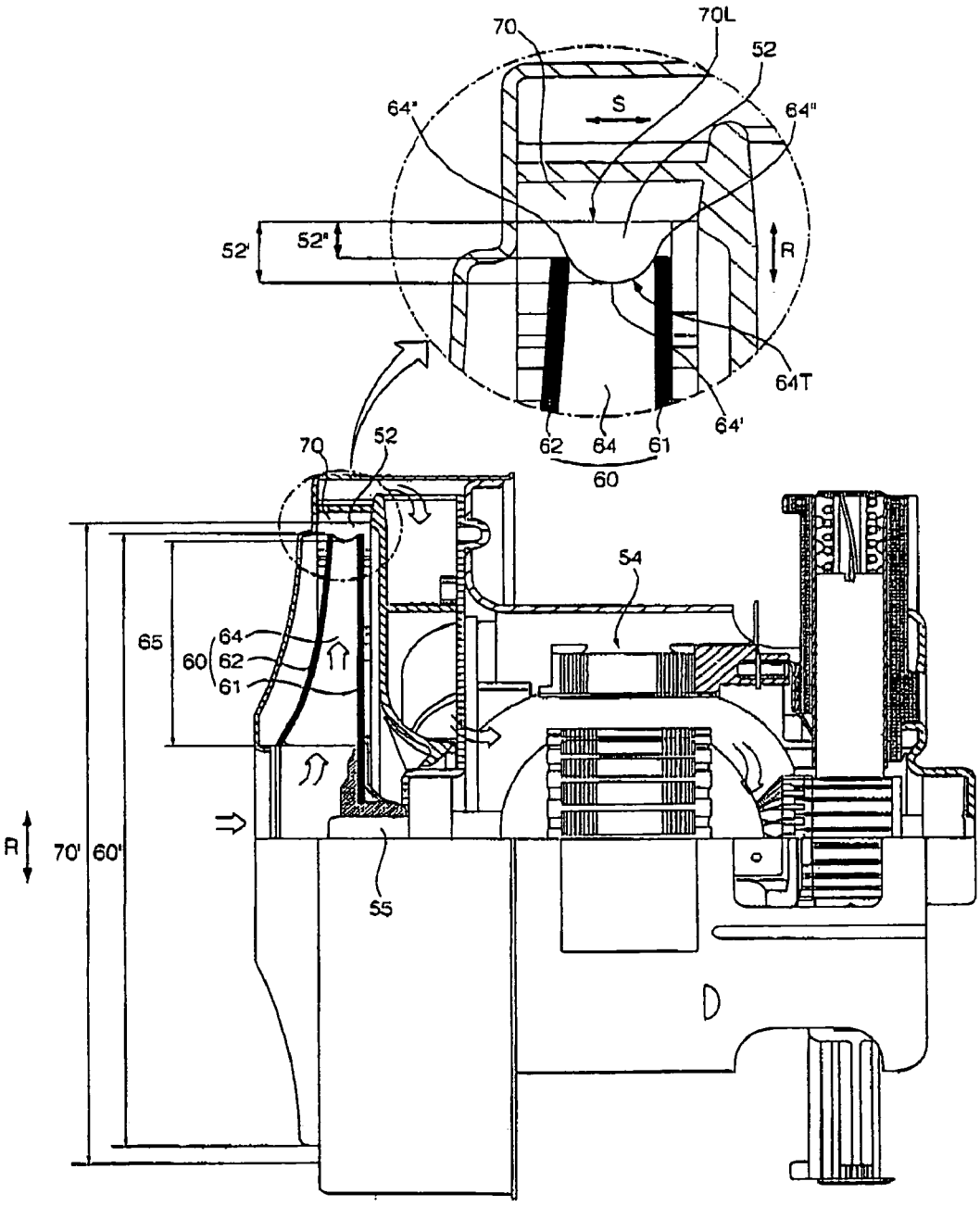
FIG. 3 is a cross-sectional view, in part, showing an air-blowing apparatus of a cleaner according to a preferred embodiment of the present invention.

FIG. 3 is a cross-sectional view, in part, showing an air-blowing apparatus of a cleaner according to a preferred embodiment of the present invention.

The air-blowing apparatus of the cleaner according to the preferred embodiment of the present invention includes: a fan 60 rotatably mounted in a fan housing 50 for generating a blowing force in the centrifugal direction thereof; and a diffuser 70 disposed outside the fan 60 in the radial direction (indicated by an arrow R) of the fan 60, and fixedly mounted in the fan housing 50 for diffusing air blown from the fan 60. The distance 52 between the fan 60 and the diffuser 70 is set such that at least a portion 52' of the distance 52 is larger than the other portion 52" of the distance 52, which is defined between the outer diameter 60' of the fan 60 and the inner diameter 70' of the diffuser 70. Therefore, the distance 52 means the distance between a trailing edge 64T of a blade 64 of the fan 60 and a leading edge 70L of the diffuser 70 as shown in FIG. 3.

The fan 60 comprises: a first plate 61 fixed to a rotary shaft 55 of a motor 54; a second plate 62 disposed while being spaced apart from the first plate 61 in the axial direction (indicated by arrow S) of the fan 60; and a plurality of blades 64 disposed between the first and second plates 61 and 62 while being uniformly spaced apart from each other in the circumferential direction of the fan 60.

The first plate 61 of the fan 60 is formed in the shape of a ring having an outer diameter identical to the outer diameter 60' of the fan 60. Similarly, the second plate 62 of the fan 60 is formed in the shape of a ring having an outer diameter identical to the outer diameter 60' of the fan 60.

The blades 64 of the fan 60 are arranged such that the end of each blade at the side of the diffuser 70 is placed on the same line as the outer diameter 60' of the fan 60 in the radial direction (indicated by the arrow R) of the fan 60.

At least a part of each blade 64 of the fan 60 is shorter than the other part of the blade 64 extending to the outer diameter 60' of the fan 60. Consequently, at least a portion 52' of the distance 52 between the fan 60 and the diffuser 70 is larger than the other portion 52" of the distance 52, which is defined between the outer diameter 60' of the fan 60 and the inner diameter 70' of the diffuser 70.

The blade 64 of the fan 60 is symmetrical in the axial direction (indicated by the arrow S) of the fan 60 so that flow of air blown from the fan 60 to the diffuser 70 is uniform in the axial direction (indicated by the arrow S) of the fan 60.

As the distance between the fan 60 and the diffuser 70 is increased, flow loss of air is increased with the result that blowing efficiency is decreased. For this reason, the blades 64 of the fan 60 are formed such that the minimum distance 65 of each blade 64 of the fan 60 from the center of the fan 60 to the end of the fan at the side of the diffuser 70 in the radial direction (indicated by the arrow R) of the fan 60 is 90 to 99% of the outer diameter 60' of the fan 60. Consequently, disturbance between the fan 60 and the diffuser 70 can be reduced while flow loss is minimized.

For example, each blade 64 of the fan 60 is formed such that the diameter of the middle 64' of the blade 64 is shorter, in the axial direction (indicated by the arrow S) of the fan 60, than the outer diameter 60' of the fan 60, and the diameter is gradually decreased from both ends 64" of the blade 64 to the middle 64' of the blade 64 in the axial direction (indicated by the arrow S) of the fan 60. Specifically, each blade 64 of the fan 60 has an arch-shaped groove having a prescribed curvature curved from the end of the blade 64 at the side of the diffuser 70 toward the center of the fan 60 in the radial direction (indicated by the arrow R) of the fan 60. The middle 64' of each blade 64 of the fan 60 in the axial direction (indicated by the arrow S) of the fan 60 has a minimum length 65 in the radial direction (indicated by the arrow R) of the fan 60. The minimum length 65 is 93.7% of the outer diameter 60' of the fan 60.

The operation of the air-blowing apparatus of the cleaner with the above-stated construction according to the present invention will now be described.

When the fan 60 is rotated, air is suctioned into the center of the fan 60, and is then discharged to the radial outer circumference of the fan 60 by means of a centrifugal force. The air discharged from the fan is blown to the diffuser 70 where the air is diffused.

When the air is blown from the rotating fan 60 toward the fixed diffuser 70, the air is not severely disturbed since the distance 52 between the fan 60 and the diffuser 70 is partly increased.

Comparison was made between the blade 64 of the fan 60 according to the present invention formed as shown in FIG. 3 and the blade of the fan according to the conventional art having the identical distance 52 between the fan 60 and the diffuser 70, in the axial direction of the fan 60, to the distance 52' between the outer diameter 60' of the fan 60 and the inner diameter 70' of the diffuser 70, which is indicated in Table 1 below.

TABLE 1

| | Present invention | Conventional art |
|---|---|---|
| Consumed power (W) | 1311.4 | 1364 |
| Suction power (W) | 614.1 | 617.7 |
| Suction power/Consumed power, Efficiency of fan | 46.8 | 45.3 |

It can be seen from Table 1 that disturbance of air between the fan 60 and the diffuser 70 is reduced according to the present invention, whereby noise is reduced as compared to the conventional art, and efficiency of the fan is increased 1.5%.

Other preferred embodiments of the present invention, which will be described below, are very similar to the above-mentioned preferred embodiment of the present invention in terms of the basic construction and technical concept. Consequently, the embodiments of the present invention have the same reference numerals as those of the above-mentioned preferred embodiment of the present invention, and detailed descriptions thereof will not be given.

Figure 4:
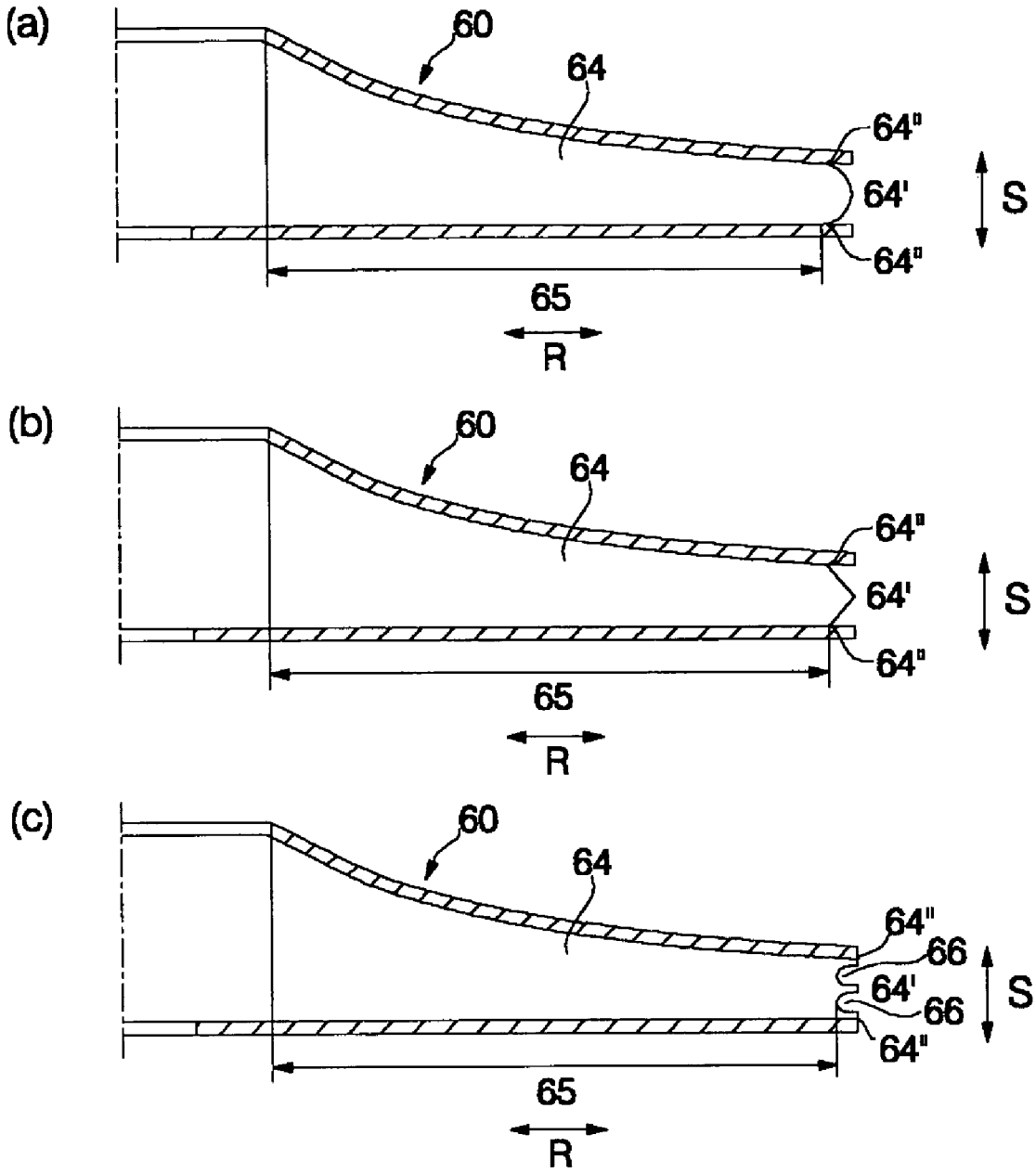
FIGS. 4 to 6 are views respectively showing the constructions of main components of air-blowing apparatuses according to other preferred embodiments of the present invention.

As shown in FIG. 4, the blades 64 of the fan 60 according to other preferred embodiments of the present invention are formed such that both ends of each blade 64 are shorter, in the axial direction (indicated by the arrow S) of the fan 60, than the middle 64' of the blade 64.

Specifically, the blade 64 of the fan 60 may be gradually shortened, in the form of a curved line having a prescribed curvature, from the middle 64' of the blade 64 to both ends 64" of the blade 64, in the axial direction of the fan 60, as shown in FIG. 4*a*. In this case, both ends 64" of the blade 64 of the fan 60 in the axial direction (indicated by the arrow S) of the fan 60 have the minimum length 65 in the radial direction (indicated by the arrow R) of the fan 60.

The blade 64 of the fan 60 may be gradually shortened, in the form of a straight line having a prescribed inclination, from the middle 64' of the blade 64 to both ends 64" of the blade 64 in the axial direction of the fan 60, as shown in FIG. 4*b*. In this case, both ends 64" of the blade 64 of the fan 60 in the axial direction (indicated by the arrow S) of the fan 60 have the minimum length 65 in the radial direction (indicated by the arrow R) of the fan 60.

The blade 64 of the fan 60 may have grooves 66 formed, in the axial direction (indicated by the arrow S) of the fan 60, between the middle 64' of the blade 64 and both ends 64" of the blade 64, respectively, as shown in FIG. 4*c*.

Figure 5:
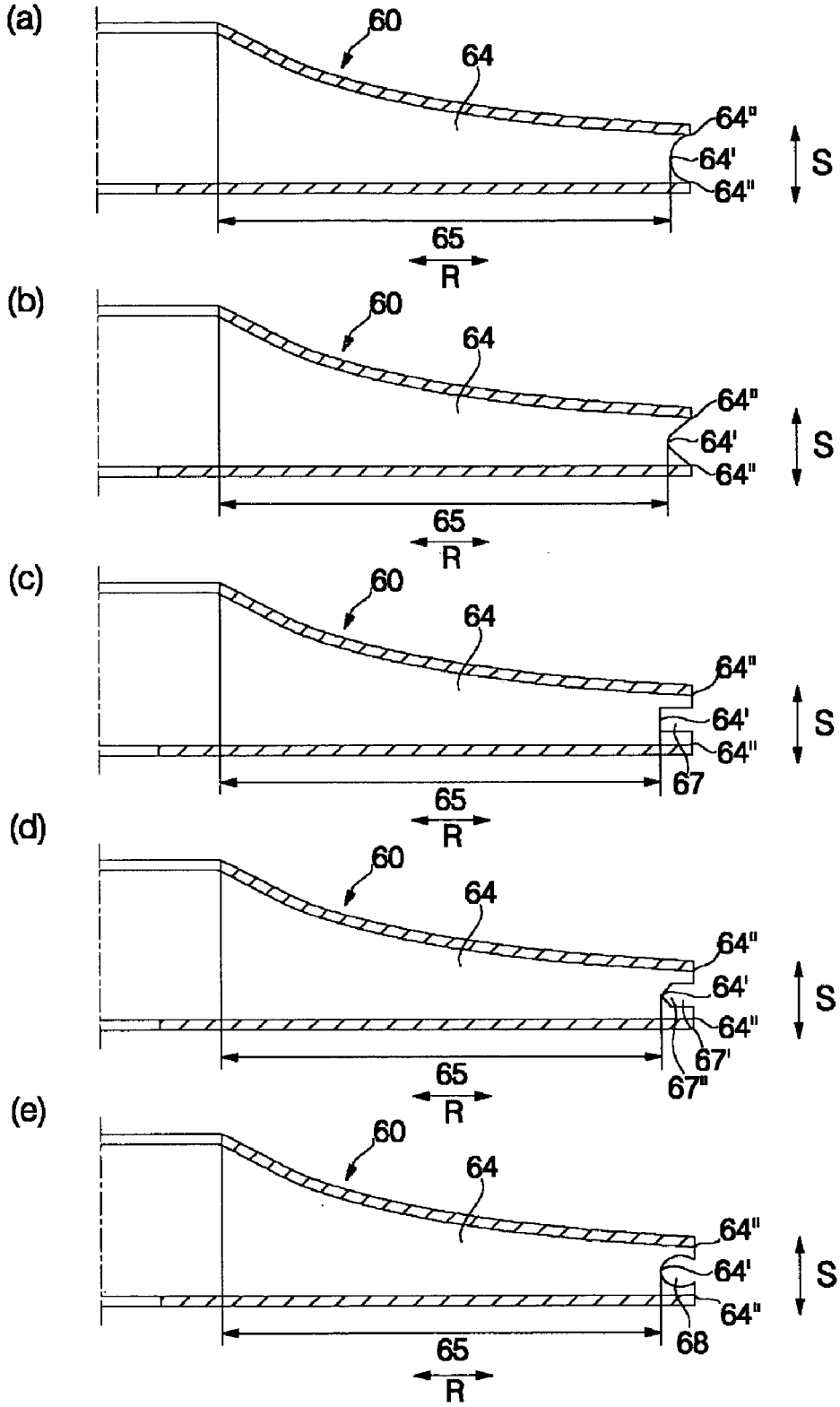

As shown in FIG. 5, the blades 64 of the fan 60 according to still other preferred embodiments of the present invention are formed such that the middle 64' of each blade 64 is shorter, in the axial direction (indicated by the arrow S) of the fan 60, than both ends of the blade 64. In this case, the middle 64' of the blade 64 of the fan 60 in the axial direction of the fan 60 have the minimum length 65 in the radial direction (indicated by the arrow R) of the fan 60.

Specifically, the blade 64 of the fan 60 may be gradually shortened, in the form of a curved line having a prescribed curvature, from both ends 64" of the blade 64 to the middle 64' of the blade 64, in the axial direction of the fan 60, as shown in FIGS. 5*a* and 3. In this case, the middle 64' of the blade 64 of the fan 60 in the axial direction (indicated by the arrow S) of the fan 60 have the minimum length 65 in the radial direction (indicated by the arrow R) of the fan 60.

The blade 64 of the fan 60 may be gradually shortened, in the form of a straight line having a prescribed inclination, from both ends 64" of the blade 64 to the middle 64' of the blade 64, in the axial direction of the fan 60, as shown in FIG. 5*b*. In this case, the middle 64' of the blade 64 of the fan 60 in the axial direction (indicated by the arrow S) of the fan 60 have the minimum length 65 in the radial direction (indicated by the arrow R) of the fan 60.

The blade 64 of the fan 60 may have a rectangular groove 67 formed at the middle 64' of the blade 64 in the axial direction (indicated by the arrow S) of the fan 60 toward the center of the fan 60, as shown in FIG. 5*c*. Consequently, the middle 64' of the blade 64 is shorter than both ends 64" of the blade 64.

The blade 64 of the fan 60 may have a rectangular groove 67' formed at the middle 64' of the blade 64 in the axial direction (indicated by the arrow S) of the fan 60 toward the center of the fan 60, and a triangular groove 67" further formed at the rectangular groove 67' toward the center of the fan 60, as shown in FIG. 5*d*. Consequently, the middle 64' of the blade 64 is further shorter than both ends 64" of the blade 64.

The blade 64 of the fan 60 may have an elliptical, groove 68, which is partly cut, formed at the middle 64' of the blade 64 in the axial direction (indicated by the arrow S) of the fan 60 toward the center of the fan 60, as shown in FIG. 5*e*.

Consequently, the middle 64' of the blade 64 is further shorter than both ends 64" of the blade 64.

Figure 6:
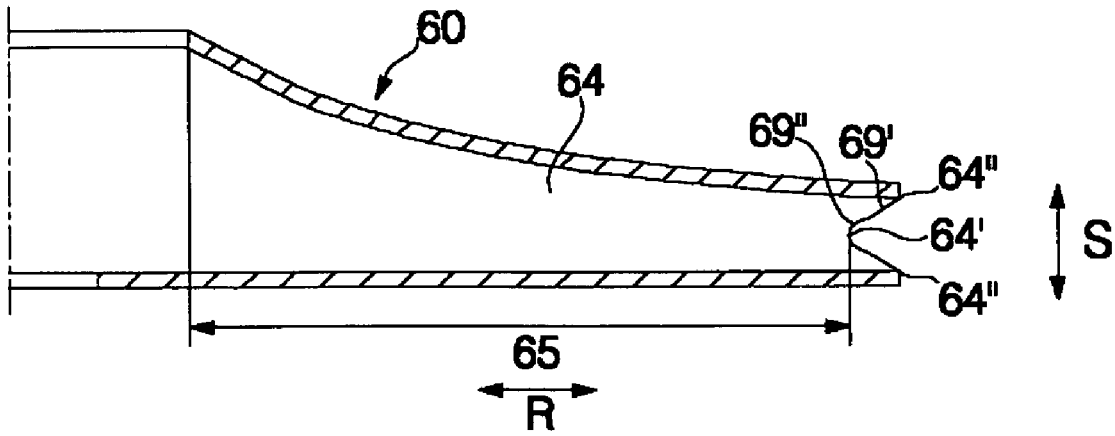

Otherwise, the blade 64 of the fan 60 may have straight line parts 69' gradually shortened in the form of a straight line having a prescribed inclination from both ends 64" of the blade 64 to the middle 64' of the blade 64 in the axial direction of the fan 60 and curved line parts 69" gradually shortened in the form of a curved line having a prescribed curvature from the inner ends of the straight line parts 69' to the middle 64' of the blade 64 in the axial direction of the fan 60, as shown in FIG. 6. Consequently, the middle 64' of the blade 64 is shorter than both ends 64" of the blade 64.

Noise was measured on the basis of the shapes of the blade 64' of the fan 60 according to the present invention as shown in FIGS. 3 to 6 and the conventional art, results of which are indicated in Table 2. The number of the blades 64 of the fan was 9, the outer diameter 60' of the fan 60 was 95 mm, and the axial height 60" of the fan 60 at the outer diameter 60' was 8 mm.

TABLE 2

| Embodiments | Minimum radial length of blade of fan/ Outer diameter of fan (%) | Log amount of noise throughout all spectra (dB(A)) | Peak noise (dB(A)) |
|---|---|---|---|
| Conventional art | 100 | 92 | 84 |
| FIG. 4c | 95 | 89.4 | 77.5 |
| FIG. 5a | 93.7 | 88.6 | 68.6 |
| FIG. 5b | 96.8 | 89.1 | 71.1 |
| FIG. 5c | 95 | 89.1 | 82.5 |
| FIG. 5d | 95 | 88.4 | 59.2 |
| FIG. 5e | 95 | 89.5 | 70.0 |
| FIG. 6 | 95 | 89.0 | 69.3 |

It can be seen from Table 2 that noise is reduced as compared to the conventional art when the distance 52 between the blade 64 of the fan 60 and the diffuser 70 is at least partly increased in the axial direction (indicated by the arrow S) of the blade 64 of the fan 60.

As apparent from the above description, the present invention provides an air-blowing apparatus of a cleaner wherein at least a portion of the distance between a fan and a diffuser is larger, in the axial direction of the fan, than the other portion of the distance, which is defined between the outer diameter of the fan and the inner diameter of the diffuser, whereby noise is reduced while blowing efficiency is not seriously affected.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air-blowing apparatus of a cleaner, comprising:

a fan to generate a blowing force in the centrifugal direction thereof, and said fan having plurality of blades spaced apart from each other in the circumferential direction of the fan; and a diffuser disposed outside the fan in the radial direction of the fan to diffuse air blown from the fan, wherein each of the blades is formed such that a distance between a trailing edge of the blade and a leading edge of the diffuser at a middle of the blade is shorter than the distance between the trailing edge of the blade and the leading edge of the diffuser at both ends of the blade.

2. The apparatus as set forth in claim 1, wherein each of the blades of the fan is symmetrical in the axial direction of the fan.

3. The apparatus as set forth in claim 1, wherein the blades of the fan are formed such that a minimum distance of each blade of the fan from the center of the fan to the end of the fan at the side of the diffuser in the radial direction of the fan is 90 to 99% of an outer diameter of the fan.

4. The apparatus as set forth in claim 1, wherein each blade of the fan is gradually shortened, in the form of a straight line, from the middle of the blade to both ends of the blade in the axial direction of the fan.

5. The apparatus as set forth in claim 1, wherein each blade of the fan is gradually shortened, in the form of a curved line, from the middle of the blade to both ends of the blade in the axial direction of the fan.

6. The apparatus as set forth in claim 1, wherein each blade of the fan has grooves formed, in the axial direction of the fan, between the middle of the blade and both ends of the blade, respectively.

7. The apparatus as set forth in claim 1, wherein each blade of the fan has straight line parts gradually shortened in the form of a straight line in the axial direction of the fan and curved line parts gradually shortened in the form of a curved line in the axial direction of the fan.

8. An air-blowing apparatus of a cleaner, comprising:

a fan to generate a blowing force in the centrifugal direction thereof, and said fan having plurality of blades spaced apart from each other in the circumferential direction of the fan; and a diffuser disposed outside the fan in the radial direction of the fan to diffuse air blown from the fan, wherein each of the blades is formed such that a distance between a trailing edge of the blade and a leading edge of the diffuser at a middle of the blade is longer than the distance between the trailing edge of the blade and the leading edge of the diffuser at both ends of the blade; and wherein each blade of the fan is gradually shortened, in the form of a straight line, from both ends of the blade to the middle of the blade in the axial direction of the fan.

9. An air-blowing apparatus of a cleaner, comprising:

a fan to generate a blowing force in the centrifugal direction thereof, and said fan having plurality of blades spaced apart from each other in the circumferential direction of the fan; and a diffuser disposed outside the fan in the radial direction of the fan to diffuse air blown from the fan, wherein each of the blades is formed such that a distance between a trailing edge of the blade and a leading edge of the diffuser at a middle of the blade is longer than the distance between the trailing edge of the blade and the leading edge of the diffuser at both ends of the blade;

wherein each blade of the fan is gradually shortened, in the form of a curved line, from both ends of the blade to the middle of the blade in the axial direction of the fan.

10. An air-blowing apparatus of a cleaner, comprising:

a fan to generate a blowing force in the centrifugal direction thereof, and said fan having plurality of blades spaced apart from each other in the circumferential direction of the fan; and a diffuser disposed outside the fan in the radial direction of the fan to diffuse air blown from the fan, wherein each of the blades is formed such that a distance between a trailing edge of the blade and a leading edge of the diffuser at a middle of the blade is longer than the distance between the trailing edge of the blade and the leading edge of the diffuser at both ends of the blade;

wherein each blade of the fan has a rectangular groove formed at the middle of the blade.

11. The apparatus as set forth in claim 10, wherein each blade of the fan further has a triangular groove formed at the rectangular groove toward the center of the fan.

12. An air-blowing apparatus of a cleaner, comprising:

a fan to generate a blowing force in the centrifugal direction thereof, and said fan having plurality of blades spaced apart from each other in the circumferential direction of the fan; and a diffuser disposed outside the fan in the radial direction of the fan to diffuse air blown from the fan, wherein each of the blades is formed such that a distance between a trailing edge of the blade and a leading edge of the diffuser at a middle of the blade is longer than the distance between the trailing edge of the blade and the leading edge of the diffuser at both ends of the blade;

wherein each blade of the fan has an elliptical groove formed at the middle of the blade, the elliptical groove being partly cut.

13. An air-blowing apparatus of a cleaner, comprising:

a fan to generate a blowing force in the centrifugal direction thereof, and said fan having plurality of blades spaced apart from each other in the circumferential direction of the fan; and a diffuser disposed outside the fan in the radial direction of the fan to diffuse air blown from the fan, wherein each of the blades is formed such that a distance between a trailing edge of the blade and a leading edge of the diffuser at a middle of the blade is longer than the distance between the trailing edge of the blade and the leading edge of the diffuser at both ends of the blade;

wherein each of the blades is formed such that a minimum distance of each blade of the fan from the center of the fan to the end of the fan at the side of the diffuser in the radial direction of the fan is 90 to 99% of an outer diameter of the fan.

* * * * *